US010800026B1

(12) United States Patent
Hsiao

(10) Patent No.: US 10,800,026 B1
(45) Date of Patent: Oct. 13, 2020

(54) STRUCTURE OF TOOL HEAD BEARING-SEAT

(71) Applicant: YUN CHAN INDUSTRY CO., LTD., New Taipei (TW)

(72) Inventor: Fu-Jui Hsiao, New Taipei (TW)

(73) Assignee: YUN CHAN INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/418,991

(22) Filed: May 21, 2019

(51) Int. Cl.
*B65D 85/28* (2006.01)
*B25H 3/00* (2006.01)
*B25H 3/02* (2006.01)

(52) U.S. Cl.
CPC ..... *B25H 3/003* (2013.01); *B25H 3/023* (2013.01)

(58) Field of Classification Search
CPC ..... B25H 3/003; B25H 3/023; B25H 3/021; B25H 3/006
USPC ..... 206/349, 372–379; 211/70.6
See application file for complete search history.

(56) References Cited

U.S. PATENT DOCUMENTS 4,253,830 A * 3/1981 Kazen ..... A61C 3/04 206/368
4,770,297 A * 9/1988 Chang ..... B65D 85/28 206/379
5,456,359 A * 10/1995 Horn ..... B25H 3/06 206/378
5,560,480 A * 10/1996 Singleton ..... B25H 3/06 206/373
5,967,318 A * 10/1999 Rosler ..... B25H 3/003 206/372
6,047,827 A * 4/2000 Huang ..... B25G 1/005 206/349
2003/0015444 A1* 1/2003 Molin ..... A61M 5/002 206/366
2003/0205542 A1* 11/2003 Chen ..... B25H 3/006 211/70.6
2018/0361564 A1* 12/2018 Hurley ..... B25H 3/003

* cited by examiner

*Primary Examiner* — Luan K Bui
(74) *Attorney, Agent, or Firm* — Leong C. Lei

(57) ABSTRACT

A structure of tool head bearing-seat, comprising: a main-body; a bearing space defined in the main-body; an opening formed on the main-body and communicated with the bearing space; an elastic position-limiting portion set at one side of the bearing space; at least one first connecting-portion and third connecting-portion with corresponding shape; and at least one second connecting-portion and fourth connecting-portion with corresponding shape respectively set at the sides of the first connecting-portion and the third connecting-portion. The user can place the tool head in the bearing space through the opening and limit the tool head position through the elastic position-limiting portion to prevent the tool head from falling out. When the main-bodies are connected to each other, the first connecting-portion and the second-connecting portion can be connected to the third-connecting portion and the fourth-connecting portion; therefore the main-bodies can be connected to each other rather stably and firmly.

6 Claims, 10 Drawing Sheets

STRUCTURE OF TOOL HEAD BEARING-SEAT

(a) TECHNICAL FIELD OF THE INVENTION

The present invention provides a structure of tool head bearing-seat, and especially relates to a structure of tool head bearing-seat which can be relatively stable and firm when connected to each other.

(b) DESCRIPTION OF THE PRIOR ART

Generally, the concept of DIY is quite common in modern times, so there are many DIY products in modern times, such as cabinets, chairs, etc.; and when assembling these products, almost all of them need to use the screws to lock the parts. Normally, people will use a screwdriver to lock the screw, but some people may need to perform assembly operations from time to time due to work. If a manual screwdriver is used, it will be more laborious, so it will be locked with an electric screwdriver cooperatedly.

Since the price of the electric screwdriver is not cheap, it will be replaced with various screwdriver tool heads to cope with various types of screws; so the number of tool heads will naturally not be less. In general, the tool heads also use some carrying devices to store. However, most of the carrying devices cannot be expanded and connected, and are also unstable when stored. It is easy to cause the tool heads to fall out and cause loss.

SUMMARY OF THE INVENTION

The main objective of the present invention is to enable the main-bodies to be stably and firmly connected with each other and to fix the tool head via the elastic position-limiting portion to prevent from falling out.

In order to achieve the above-mentioned objectives, the main structure of the present invention comprises: a main-body, at least one bearing space defined in the main-body, an opening formed on the main-body and communicated with the bearing space, at least one elastic position-limiting portion set at one side of the bearing space, at least one first connecting-portion set on the main-body, at least one second connecting-portion set at the side of the first connecting-portion, at least one third connecting-portion set on the main-body and which location is different from the first connecting-portion, at least one fourth connecting-portion set at the side of the third connecting-portion; wherein the shape of the third connecting-portion is corresponding to the first connecting-portion and can be correspondingly connected with each other; and the shape of the fourth connecting-portion is corresponding to the second connecting-portion and can be correspondingly connected with each other.

With the above-mentioned structure, the user can place the tool head in the bearing space through the opening; and use the elastic limiting portion to perform the action of position-limiting and fixing the tool head to prevent the tool head from falling out of the opening. If the user has a plurality of main-bodies, the first connecting-portion and the second connecting-portion can be aligned with the third connecting-portion and the fourth connecting-portion; and be connected with each other; thus the main-bodies can be joined with each other; and through the mutual docking effect of the first connecting-portion, the second connecting-portion, the third connecting-portion, and the fourth connecting-portion; the main-bodies can be connected to be rather stable and firm.

With the above-mentioned techniques, it is possible to make a breakthrough for the problem that the conventional tool head carrying devices cannot be connected and the tool head cannot be fixed, and so as to achieve the practicality and progressiveness with the above advantages.

DETAILED DESCRIPTION OF THE PREFERRED EMBODIMENTS

The following descriptions are exemplary embodiments only, and are not intended to limit the scope, applicability or configuration of the invention in any way. Rather, the following detailed description provides a convenient illustration for implementing exemplary embodiments of the invention. Various changes to the described embodiments may be made in the function and arrangement of the elements described without departing from the scope of the invention as set forth in the appended claims.

The foregoing and other aspects, features, and utilities of the present invention will be best understood from the following detailed description of the preferred embodiments when read in conjunction with the accompanying drawings.

Figure 1:
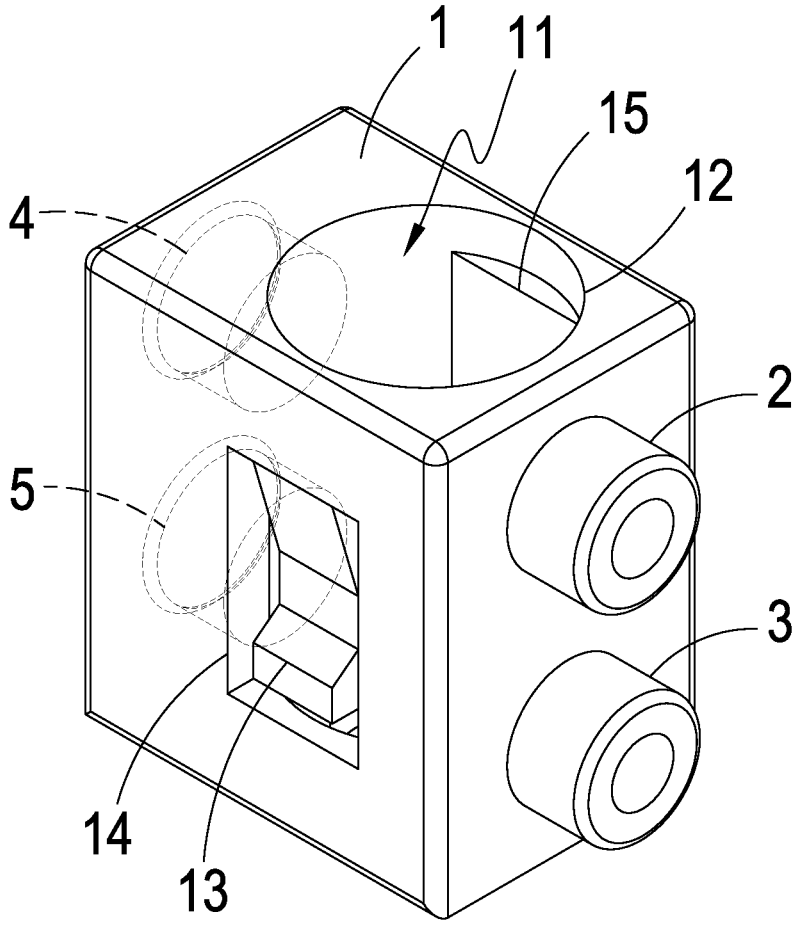
FIG. 1 is a stereo perspective view of the preferred embodiment of the present invention.
Figure 2:
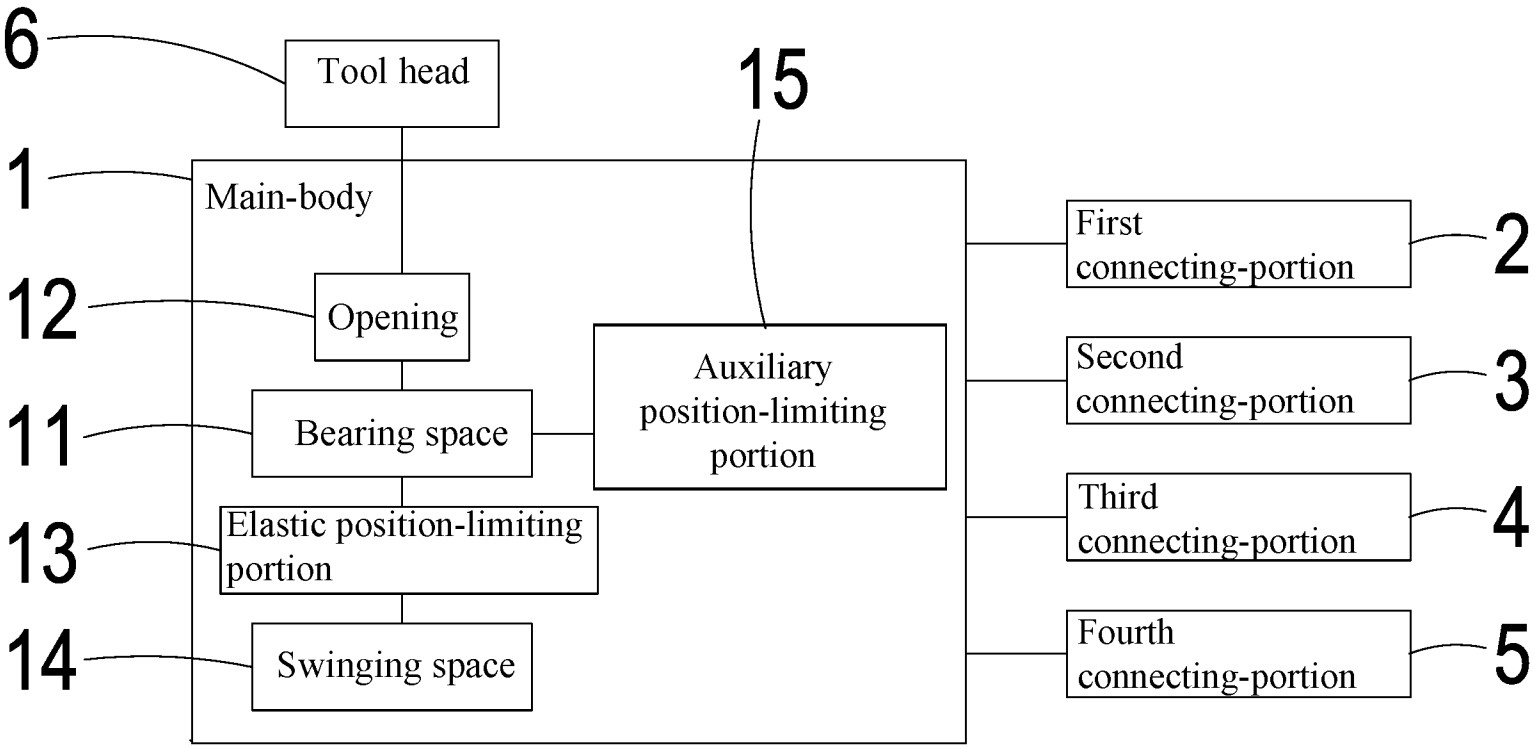
FIG. 2 is a structure block diagram of the preferred embodiment of the present invention.
Figure 3:
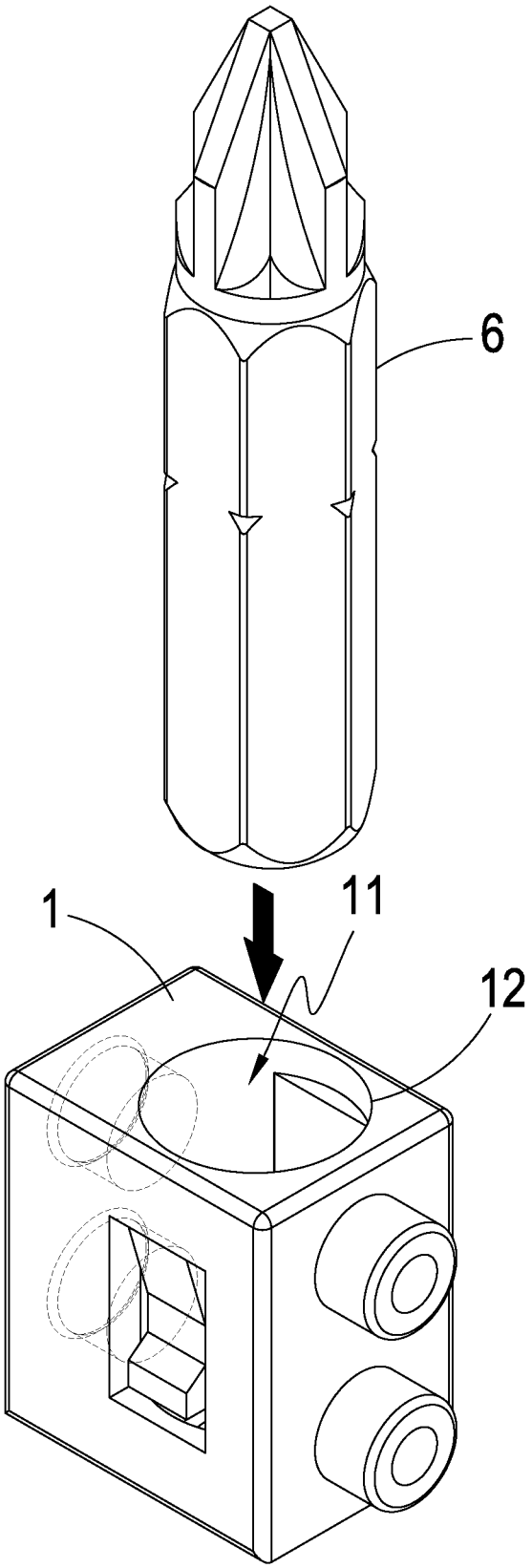
FIG. 3 is a placement schematic diagram of the preferred embodiment of the present invention.
Figure 4:
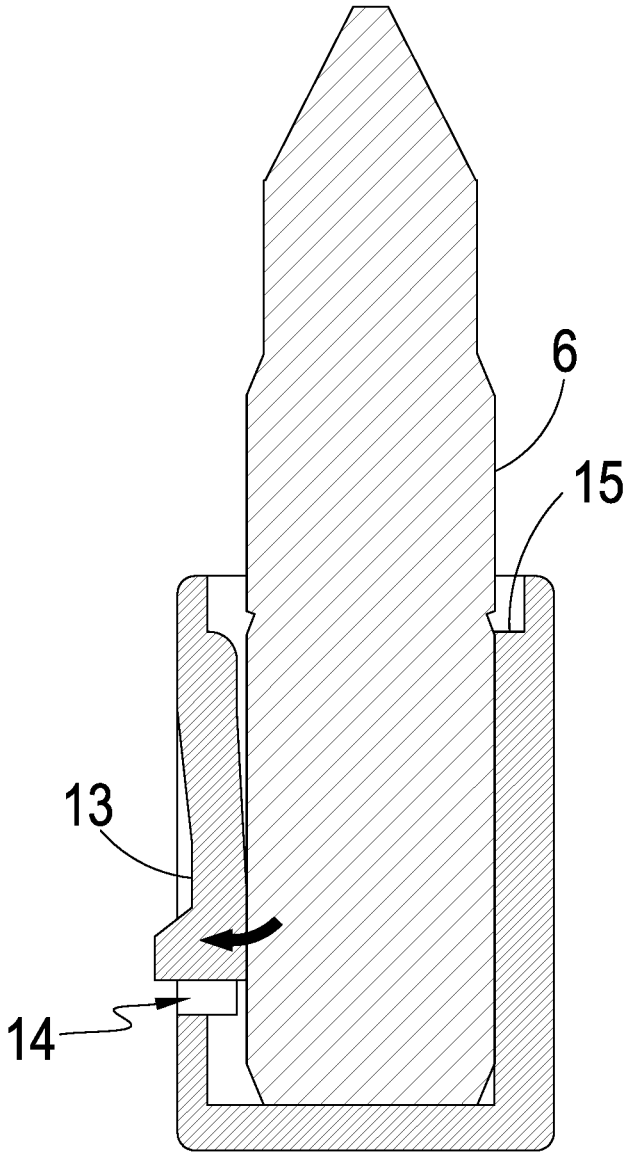
FIG. 4 is an engagement schematic diagram of the preferred embodiment of the present invention.
Figure 5:
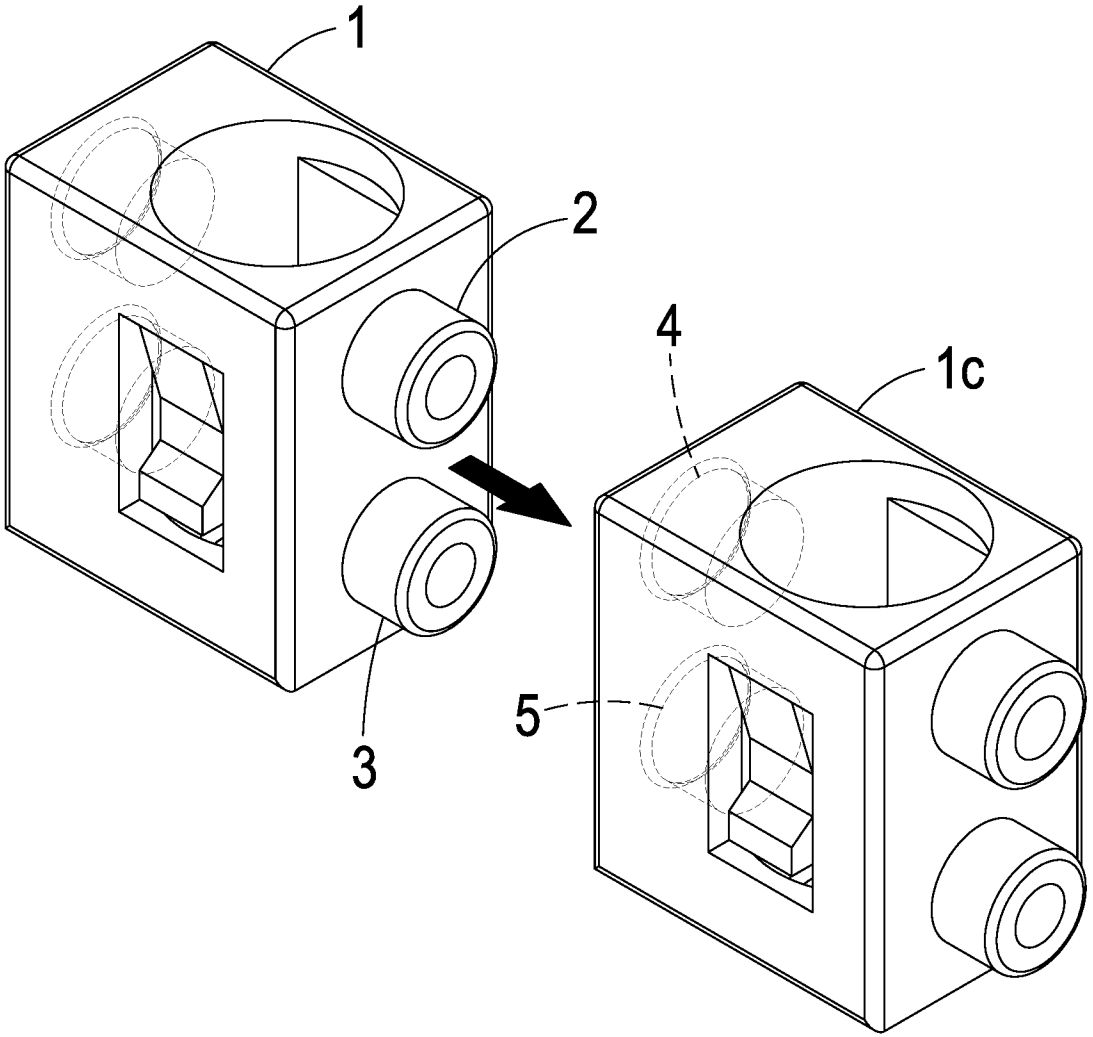
FIG. 5 is a connection schematic diagram of the preferred embodiment of the present invention.

Please refer to FIG. 1 to FIG. 3, which are the stereo perspective view to the placement schematic diagram of the preferred embodiment of the present invention; it can be clearly seen from the figures that the present invention comprises: a main-body 11, a bearing space 11, an opening 12, an elastic position-limiting portion 13, a first connecting-portion 2, a second connecting-portion 3, a third connecting-portion 4, and a fourth connecting-portion 5; wherein the bearing space 11 is defined in the main-body 1, and the opening 12 is formed on the main-body 1 and is communicated with the bearing space 11; wherein the cross section of the bearing space 11 is one of a circle, a triangle, a quadrangle, a hexagon, or an octagon to match with various different tool heads 6; it is not limited; and which is exemplified by a circle in this embodiment; wherein the elastic position-limiting portion 13 is an elastic piece formed at the side of the bearing space 11, and a swinging space 14 is formed at the side of the bearing space 11 of this embodiment to allow the elastic position-limiting portion 13 to be formed within and swing in the swinging space 14; wherein an auxiliary position-limiting portion 15 is formed in the bearing space 11, which the auxiliary position-limiting portion 15 is a convex portion formed in the bearing space 11 and is corresponding to the elastic position-limiting portion 13 to fix the tool head 6 more stably; wherein the first connecting-portion 2 and the second connecting-portion 3 are both bumps formed on one side of the main-body 1, and the shapes of the first connecting-portion 2 and the second connecting-portion 3 are one of circle, triangle, quadrangle, hexagon, or octagon; it is not limited; and which are exemplified by circle in this embodiment; wherein the third connecting-portion 4 and the fourth connecting-portion 5 are recessed holes formed on the main-body 1; and the shapes of the third connecting-portion 4 and the fourth connecting-portion 5 are respectively corresponding to the shapes of the first connecting-portion 2 and the second connecting-portion 3.

With the above description, the structure of the present technology can be understood; and according to the corresponding cooperation of this structure, the main-body 1 can be connected with each other more stably; and which has the advantage that the elastic position-limiting portion 13 can be used to prevent the tool head 6 from falling out; the detailed explanation will be described below.

Please simultaneously refer to FIG. 1 to FIG. 5, which are the stereo perspective view to the connection schematic diagram of the preferred embodiment of the present invention; when the above-mentioned components are assembled, it can be clearly seen from the figures that the user can put the tool head 6 into the bearing space 11 from the opening 12 to store the tool head 6; after the tool head 6 enters the bearing space 11, the elastic position-limiting portion 13 is pushed and pressed by the tool head 6 to move in the swinging space 14; at the same time, the auxiliary position-limiting portion 15 is pushed and pressed by the tool head 6 using the elastic force given by the elastic position-limiting portion 13 to produce a fixing and position-limiting force; therefore, the tool head 6 can be completely fixed in the bearing space 11 to prevent the tool head 6 from falling out of the opening 12, causing a problem of loss.

If the user has a plurality of main-bodies 1 and wants to increase the storage space; the first connecting-portion 2 and the second connecting-portion 3 on the main-body 1 can be correspondingly engaged with the third connecting-portion 4 and the fourth connecting-portion 5 of the other main-body 1*c*; since there are two or more engagement points between the main body 1 and the main body 1*c*, the rotation situation will not occur, so that the fixing between the main body 1 and the main body 1*c* can be more stabilized to conveniently store.

Figure 6:
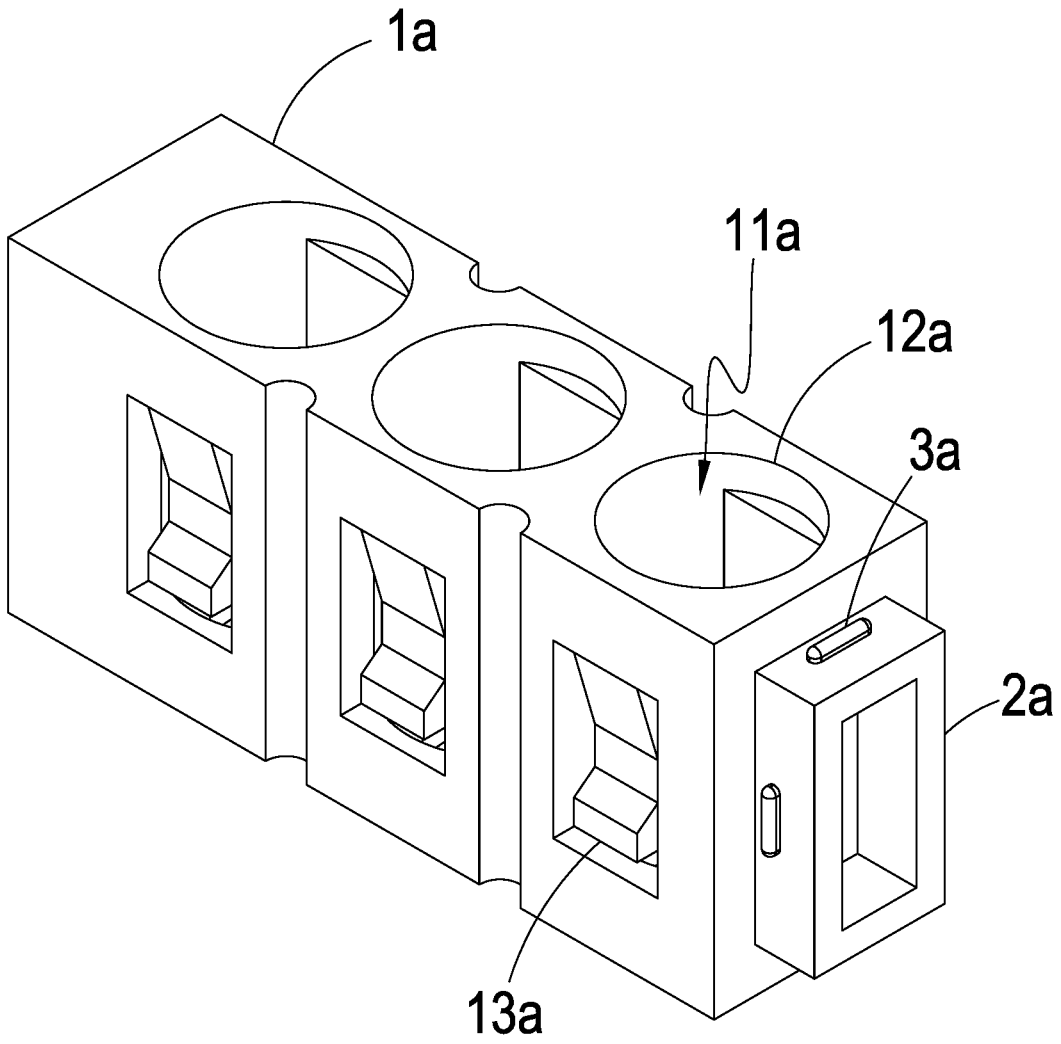
FIG. 6 is a stereo diagram of another preferred embodiment of the present invention.
Figure 7:
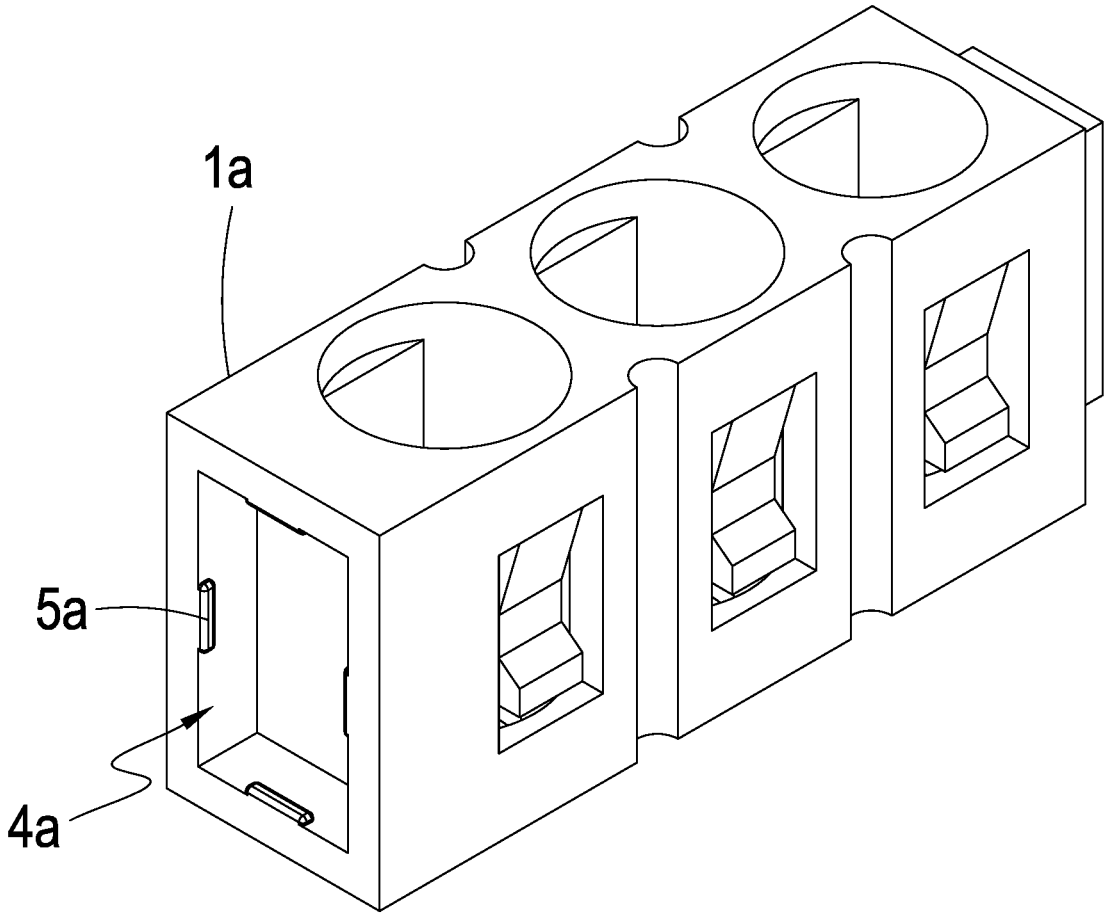
FIG. 7 is a stereo diagram of another angle of another preferred embodiment of the present invention.
Figure 8:
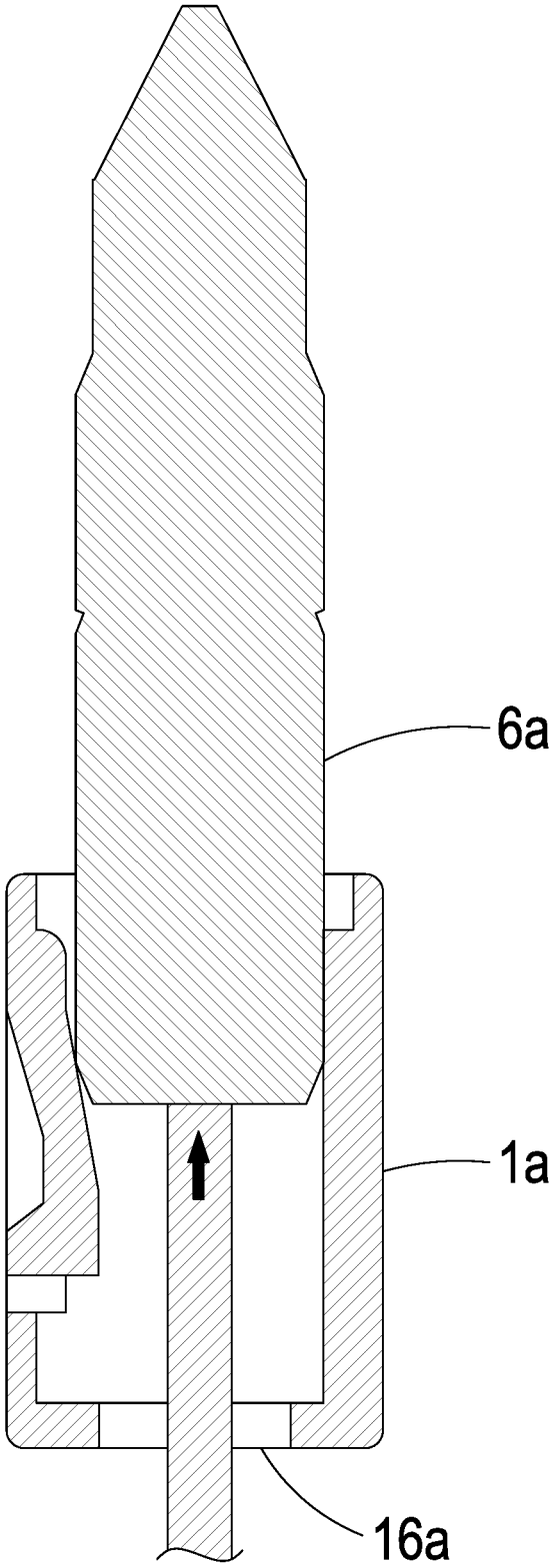
FIG. 8 is a push-out schematic diagram of another preferred embodiment of the present invention.

Please simultaneously refer to FIG. 6 to FIG. 8, which are the stereo diagram to the push-out schematic diagram of another preferred embodiment of the present invention; it can be clearly seen from the figures that this embodiment is almost the same with the above-mentioned embodiment; the difference is only that the number of the bearing space 11*a*, the opening 12*a*, and the elastic position-limiting portion 13*a* are plural; by this to represent that the number is not limited, and the shape of the first connecting-portion 2*a* is exemplified by quadrangle, and the second connecting-portion 3*a* is a plurality of bumps formed on the first connecting-portion 2*a*; wherein the number and the shape of the third connecting-portion 4*a* and the fourth connecting-portion 5*a* are corresponding to the first connecting-portion 2*a* and the second connecting-portion 3*a*, respectively; by this to represent that the number and the shape are not limited.

In this embodiment, an auxiliary perforation 16*a* is set on the main-body 1*a* and is communicated with the bearing space 11*a*, and the auxiliary perforation 16*a* is located at one side facing away from the opening 12*a*; thus, when the tool head 6*a* is stuck and fixed in the bearing space 11*a* and is not easily taken out; the user can use the tool or the finger to push and extrude the tool head 6*a* at the position of the auxiliary perforation 16*a* to push out the tool head 6*a* to quickly and conveniently take out the tool head 6*a*.

Figure 9:
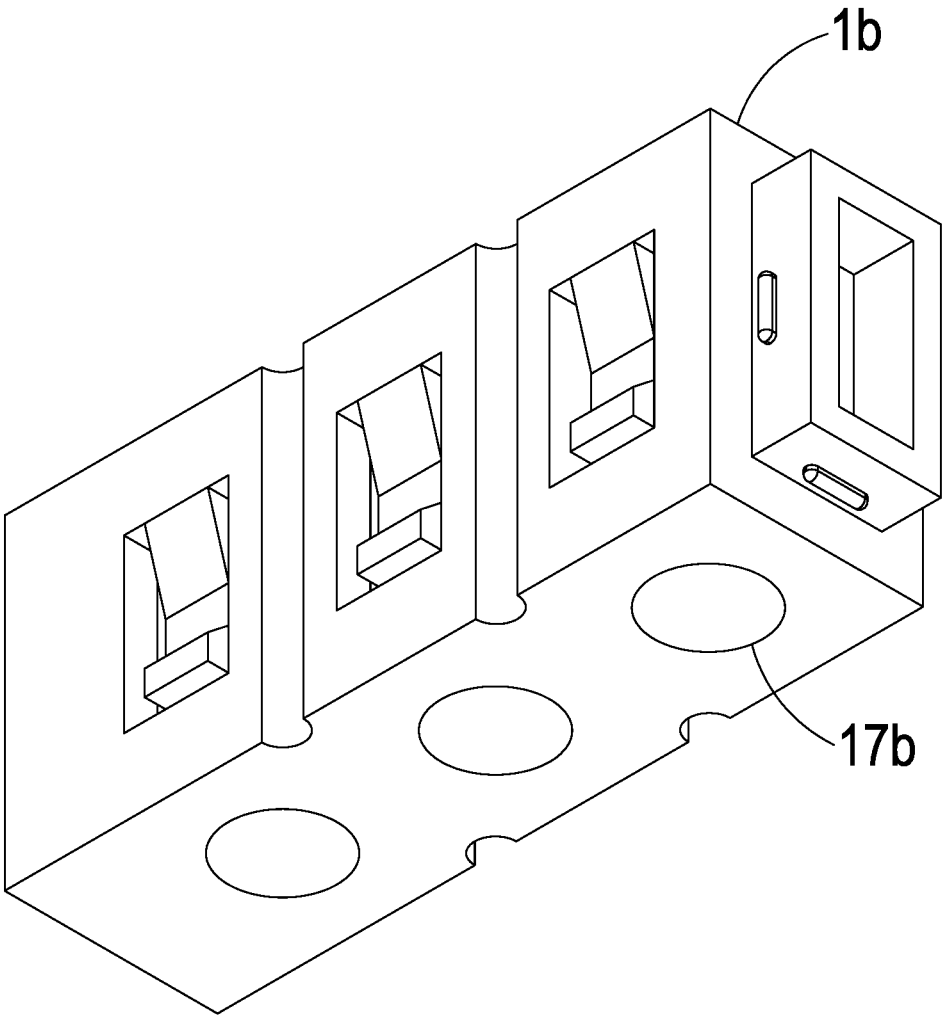
FIG. 9 is a stereo diagram of another preferred embodiment of the present invention.
Figure 10:
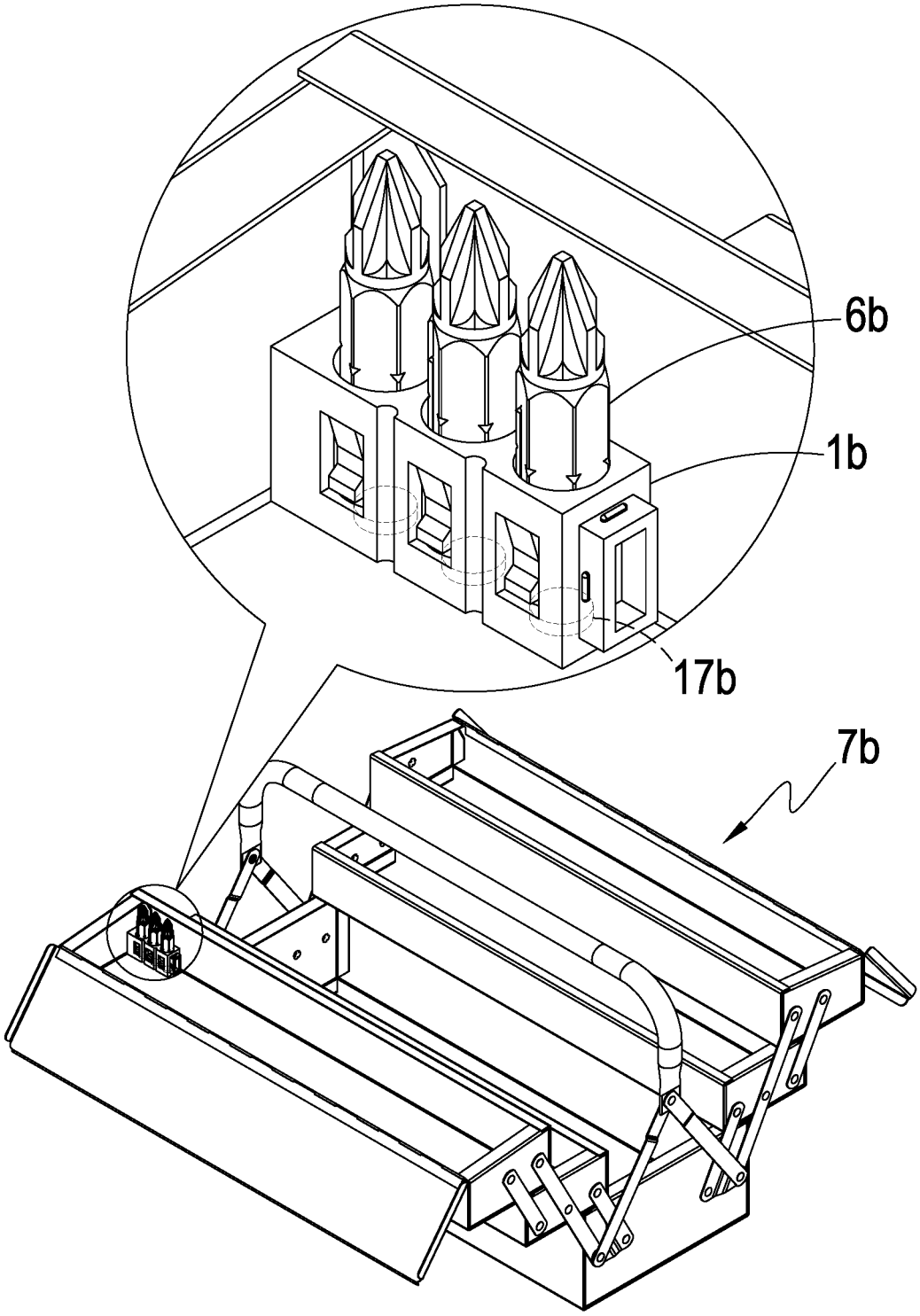
FIG. 10 is an adsorption schematic diagram of another preferred embodiment of the present invention.

Please simultaneously refer to FIG. 9 to FIG. 10, which are the stereo diagram to the adsorption schematic diagram schematic diagram of another preferred embodiment of the present invention; it can be clearly seen from the figures that this embodiment is almost the same with the above-mentioned embodiment; the difference is only that a magnetic-attraction element 17*b* is set on the main-body 1*b*; in the this embodiment, the magnetic-attraction element 17*b* is a magnet, which can adsorb the main-body 1*b* to attach on the toolbox 7*b* to assist the storage main-body 1*b*; moreover, since the tool head 6*b* is mostly made of a metal material; it can also assist the adsorption of the tool head 6*b* to fix the tool head 6*b* more stably.

Therefore, the technology key for the structure of tool head bearing-seat of the present invention to improve the conventional technology is that:

1. The tool head 6 can be fixed and position-limited more stably in the bearing space 11 via the elastic position-limiting portion 13.
2. The first connecting-portion 2, the second connecting-portion 3, the third connecting-portion 4, and the fourth connecting-portion 5 can be utilized to make between the main-bodies 1 be rather stably and firmly connected and fixed.

I claim:

1. A structure of tool head bearing-seat, which mainly comprises:

a main-body;

at least one bearing space defined in the main-body;

at least one opening formed on the main-body and communicated with the bearing space, wherein the opening is provided for placing a tool head in the bearing space through the opening;

at least one elastic position-limiting portion set at one side of the bearing space;

at least one first connecting-portion set on the main-body;

at least one second connecting-portion set at the side of the first connecting-portion;

at least one third connecting-portion, wherein the third connecting-portion is set on the main-body and located at a side different from the first connecting-portion, and the shape of the third connecting-portion corresponds to the first connecting portion; and at least one fourth connecting-portion, wherein the fourth connecting-portion is set on the main-body and located at the side of the third connecting-portion, and the shape of the fourth connecting-portion corresponds to the second connecting-portion;

wherein an auxiliary perforation is set on the main-body and is communicated with the bearing space, and the auxiliary perforation is located at one side facing away from the opening; and wherein at least one magnetic-attraction element is set on the main-body.

2. The structure of tool head bearing-seat according to claim 1, wherein an auxiliary position-limiting portion is set at a side of the bearing space, and the position of the auxiliary position-limiting portion corresponds to the elastic position-limiting portion.

3. The structure of tool head bearing-seat according to claim 1, wherein a swinging space is defined at the side of the bearing space, and the elastic position-limiting portion is located in the swinging space.

4. The structure of tool head bearing-seat according to claim 1, wherein the cross section of the bearing space is one of a circle, a triangle, a quadrangle, a hexagon, or an octagon.

5. The structure of tool head bearing-seat according to claim 1, wherein the shapes of the first connecting-portion and the second connecting-portion are one of circle, triangle, quadrangle, hexagon, or octagon.

6. The structure of tool head bearing-seat according to claim 1, wherein the second connecting-portion is a bump formed on the first connecting-portion.

* * * * *